US010359723B2

(12) United States Patent
Sato

(10) Patent No.: US 10,359,723 B2
(45) Date of Patent: Jul. 23, 2019

(54) FIXING DEVICE AND IMAGE FORMING APPARATUS THEREWITH

(71) Applicant: KYOCERA Document Solutions Inc., Osaka (JP)

(72) Inventor: Takehiro Sato, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/119,398

(22) Filed: Aug. 31, 2018

(65) Prior Publication Data

US 2019/0072889 A1 Mar. 7, 2019

(30) Foreign Application Priority Data

Sep. 7, 2017 (JP) ..... 2017-171731

(51) Int. Cl.
*G03G 15/20* (2006.01)

(52) U.S. Cl.
CPC ..... *G03G 15/2064* (2013.01)

(58) Field of Classification Search
CPC ..... G03G 15/2064; G03G 15/2032; G03G 15/2035
See application file for complete search history.

(56) References Cited

U.S. PATENT DOCUMENTS

2015/0063846 A1* 3/2015 Fukai ..... G03G 15/2032 399/45
2016/0342118 A1* 11/2016 Fukunaga ..... G03G 15/2064

FOREIGN PATENT DOCUMENTS

JP 2017-138499 A 8/2017

* cited by examiner

*Primary Examiner* — Sandra Brase
(74) *Attorney, Agent, or Firm* — Stein IP, LLC

(57) ABSTRACT

A fixing device has a fixing member, a pressing member, a pressing mechanism, a pressure changing mechanism, and a moving mechanism. The fixing member has a fixing belt. The pressing member forms a fixing nip portion by making contact with the fixing member. The pressing mechanism presses the pressing member against the fixing member to apply a nip pressure to the fixing nip portion. The pressure changing mechanism changes the nip pressure. The moving mechanism moves the fixing member in a sheet width direction which is perpendicular to a sheet conveying direction. The pressing mechanism has a holding member rotatably holding the pressing member and held swingably in such directions as to approach and recede from the fixing member. The moving mechanism moves the fixing member in the sheet width direction in coordination with the nip pressure being applied or removed by the pressure changing mechanism.

5 Claims, 6 Drawing Sheets

FIXING DEVICE AND IMAGE FORMING APPARATUS THEREWITH

INCORPORATION BY REFERENCE

This application is based upon and claims the benefit of priority from the corresponding Japanese Patent Application No. 2017-171731 filed on Sep. 7, 2017, the entire contents of which are incorporated herein by reference.

BACKGROUND

The present disclosure relates to a fixing device, and to an image forming apparatus provided with a fixing device. More particularly, the present disclosure relates to a fixing device in which a nip pressure at a fixing nip portion can be removed, and to an image forming apparatus provided with such a fixing device.

Conventionally, image forming apparatuses are provided with a fixing device for fixing a toner image transferred to a recording medium such as a sheet or the like from an image carrying member. As fixing devices, there are known those adopting a roller fixing method provided with a heating roller and a pressing roller rotating while in contact with each other, and those adopting a belt fixing method using an endless fixing belt as a heating member. For example, a fixing device of a roller fixing method heats and presses a toner image carried on a sheet in a nip portion between a fixing roller and a pressing roller kept in pressed contact with each other, and thereby fixes the toner image on the sheet.

SUMMARY

According to one aspect of the present disclosure, a fixing device includes a fixing member, a pressing member, a pressing mechanism, a pressure changing mechanism, and a moving mechanism. The fixing member has an endless fixing belt provided rotatably. The pressing member forms a fixing nip portion by making contact with the fixing member. The pressing mechanism presses the pressing member against the fixing member to apply a nip pressure to the fixing nip portion. The pressure changing mechanism changes the nip pressure at the fixing nip portion. The moving mechanism moves the fixing member in a recording medium width direction which is perpendicular to a recording medium conveying direction. The fixing device fixes an unfixed toner image to a recording medium passing through the fixing nip portion. The pressing mechanism has a holding member which rotatably holds the pressing member and which is held so as to be swingable in such directions as to approach and recede from the fixing member, and has a first biasing member biasing the holding member in such a direction that the pressing member approaches the fixing member. The pressure changing mechanism makes the first biasing member generate a biasing force to swing the holding member in a first direction, thereby to apply the nip pressure at the fixing nip portion, and removes or reduces the biasing force by the first biasing member to swing the holding member in a second direction opposite to the first direction, thereby to remove the nip pressure. The moving mechanism moves the fixing member in the recording medium width direction in coordination with the nip pressure being applied or removed by the pressure changing mechanism.

Further features and advantages of the present disclosure will become apparent from the description of embodiments given below.

DETAILED DESCRIPTION

Hereinafter, with reference to the accompanying drawings, an embodiment of the present disclosure will be described.

Figure 1:
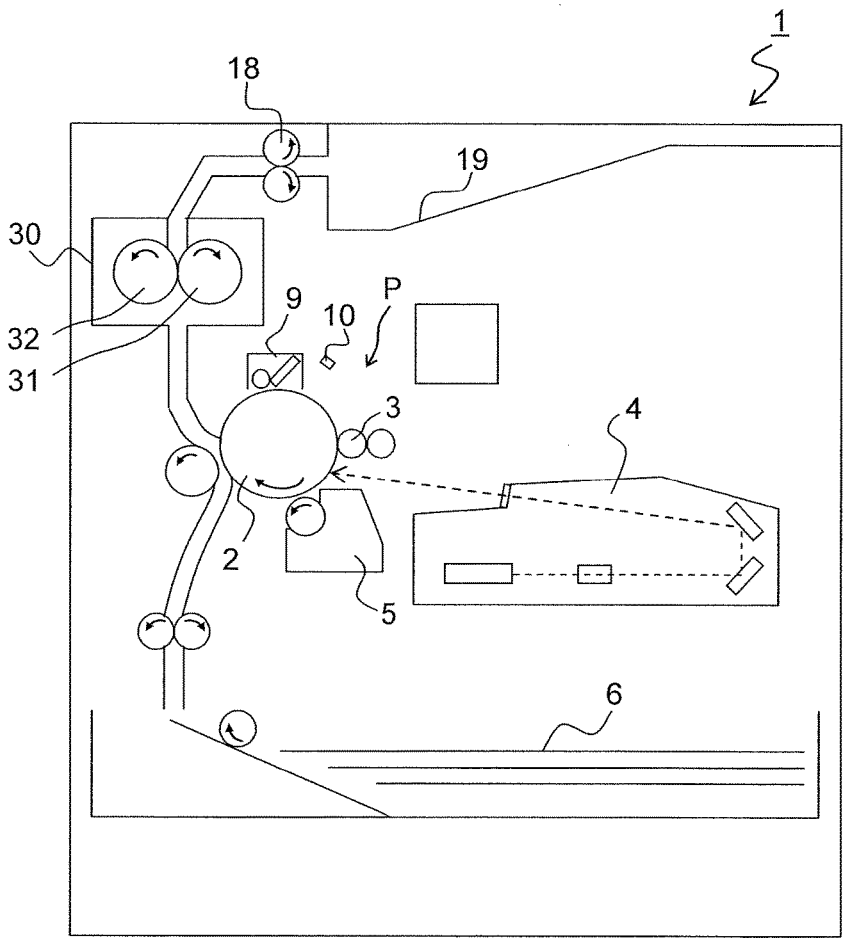
FIG. 1 is a sectional view schematically showing a structure of an image forming apparatus provided with a fixing device according to one embodiment of the present disclosure.

With reference to FIGS. 1 to 8, an image forming apparatus 1 having a fixing device 30 according to one embodiment of the present disclosure will be described. The right side in FIG. 1 corresponds to the front side of the image forming apparatus 1. As shown in FIG. 1, inside the image forming apparatus 1 (here, a monochrome printer), an image forming section P is arranged. The image forming section P forms a predetermined image through the steps of charging, exposure, developing, and transferring.

In the image forming section P, a photosensitive drum (image carrying member) 2 carrying a visible image (toner image) is arranged. The toner image formed on the photosensitive drum 2 is transferred to a sheet 6 which is an example of a recording medium, and is then fixed to the sheet 6 in the fixing device 30. Then, the sheet 6 is discharged from an apparatus main body. While the photosensitive drum 2 is rotated by an unillustrated drum driving motor in the clockwise direction in FIG. 1, the image forming process is performed with respect to the photosensitive drum 2.

Around and in front of (on the right side in FIG. 1) the photosensitive drum 2 which is rotatably arranged, there is provided a charging roller 3 for electrostatically charging the photosensitive drum 2, an exposing unit 4 for exposing the photosensitive drum 2 to light carrying image information, a developing unit 5 for forming a toner image on the photosensitive drum 2, a cleaning device 9 for collecting developer (toner) remaining on the photosensitive drum 2, and a static eliminator 10 for removing an electrostatic latent image.

The sheet 6 having a toner image transferred to it by the photosensitive drum 2 is conveyed to the fixing device 30. The sheet 6 conveyed to the fixing device 30 is heated and pressed by a fixing member 31 and a pressing roller 32 described later, so that the toner image is fixed to the surface of the sheet 6, and thereby a predetermined image is formed. The sheet 6 having passed through the fixing device 30 is discharged onto a discharged tray 19 by a discharge roller pair 18.

Figure 2:
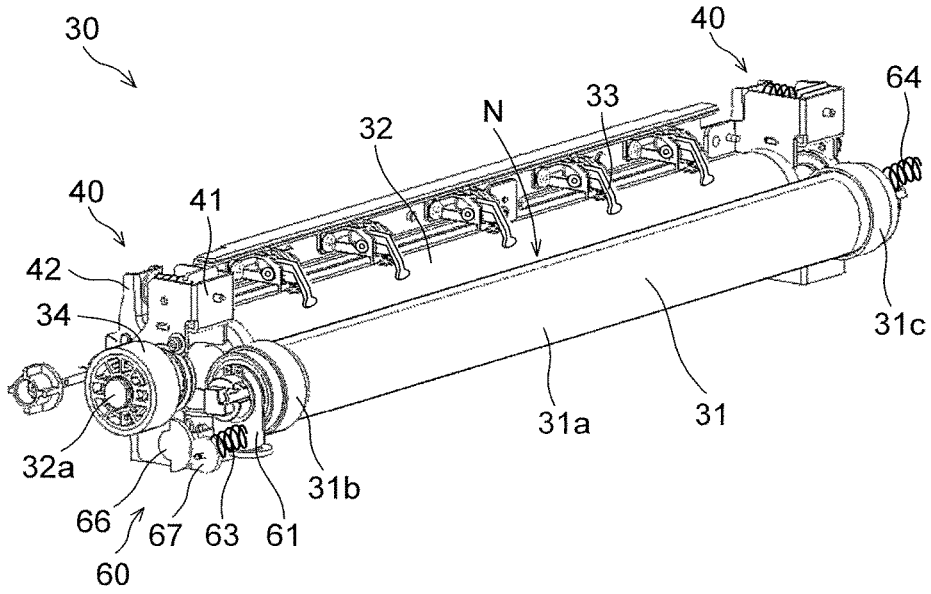
FIG. 2 is a perspective view showing a structure of the fixing device according to the one embodiment of the present disclosure.

As shown in FIG. 2, the fixing device 30 includes a fixing member 31 which is a heating member heating an unfixed toner image carried on the sheet 6, a pressing roller 32 which is a pressing member rotating while in contact with the fixing member 31 under a predetermined pressure, a pressing mechanism 40 pressing the pressing roller 32 against the fixing member 31 to apply a nip pressure to a fixing nip portion N, a pressure changing mechanism 50 (see FIG. 3) changing the nip pressure at the nip portion N by changing the pressing force of the pressing roller 32 against the fixing member 31, and a moving mechanism 60 moving the fixing member 31 in the sheet width direction which is perpendicular to the sheet conveying direction. The fixing device 30 fixes an unfixed toner image to the sheet 6 passing through the fixing nip portion N formed between the fixing member 31 and the pressing roller 32.

The fixing member 31 has an endless fixing belt 31*a* provided rotatably and a pair of caps 31*b* and 31*c* covering opposite ends of the fixing belt 31*a* respectively. Inside the fixing belt 31*a*, there are provided a belt guide member (unillustrated) guiding the inner face of the fixing belt 31*a*, a pressurizing pad (unillustrated) pressing the fixing belt 31*a* against the pressing roller 32, and the like. A heat source (unillustrated) of an electromagnetic induction heating method heating the fixing belt 31*a* is provided opposite the outer circumferential face of the fixing belt 31*a*.

The fixing belt 31*a* is flexible and is inductively heated by the heat source (unillustrated). The fixing belt 31*a* is composed of, for example, a base material layer, an elastic layer provided around the base material layer, and a release layer covering the surface of the elastic layer. The base material layer of the fixing belt 31*a* is formed of metal, such as nickel (electroformed nickel), stainless steel or the like. The inner circumferential face of the base material layer of the fixing belt 31*a* is coated by resin, such as PI, PTFE (polytetrafluoroethylene) or the like. The elastic layer of the fixing belt 31*a* is formed of, for example, silicone rubber. The release layer of the fixing belt 31*a* is formed of, for example, PFA (perfluoroalkoxy alkane).

The caps 31*b* and 31*c* are respectively attached to one end (the left end in FIG. 2) and the other end (the right end in FIG. 2) of the fixing belt 31*a*, and rotate together with the fixing belt 31*a*. The caps 31*b* and 31*c* are configured to be movable together with the fixing belt 31*a* in the thrust direction (the sheet width direction, the lateral direction in FIG. 2).

The pressing roller 32 is composed of a base material layer formed of a metal core made of aluminum, an elastic layer provided around the base material layer and formed of silicone rubber, and a release layer covering the surface of the elastic layer and formed of fluorine resin tube. On the outer circumferential face of the pressing roller 32, a plurality of (here, five) separating claws 33 separating the sheet 6 having passed through the fixing nip portion N from the pressing roller 32 are provided at predetermined intervals in the sheet width direction.

At one end (the left end in FIG. 2) of a rotary shaft 32*a* of the pressing roller 32, a driving gear 34 is attached to which a rotary driving force is transmitted from a driving source (unillustrated) such as a motor or the like. The pressing roller 32 is driven to rotate by the rotary driving force from the driving source (unillustrated), and also presses the fixing member 31 in the direction of its center. This brings the pressing roller 32 into pressed contact with the fixing member 31, and when the pressing roller 32 rotates, then the fixing member 31 follows it to rotate in the same direction at the fixing nip portion N.

Figure 3:
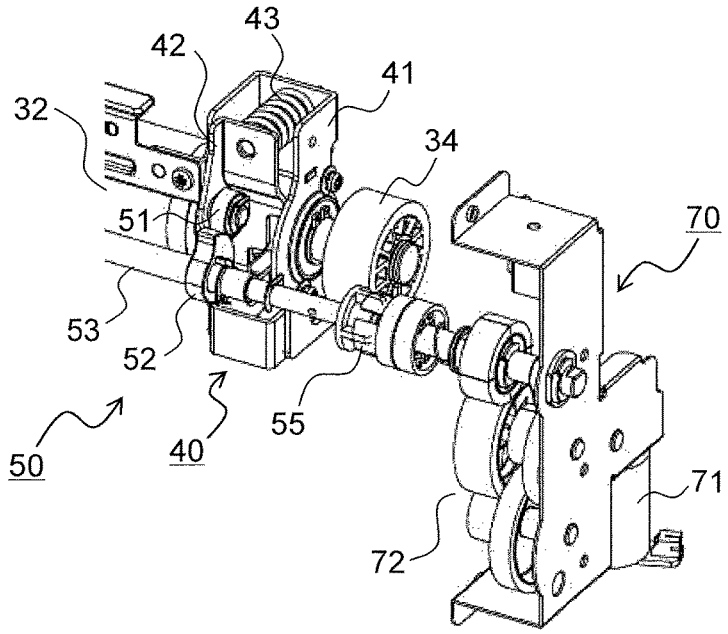
FIG. 3 is a perspective view showing a structure of and around a pressing mechanism and a pressure changing mechanism in the fixing device according to the one embodiment of the present disclosure, showing a state where a pressing roller presses a fixing member.
Figure 4:
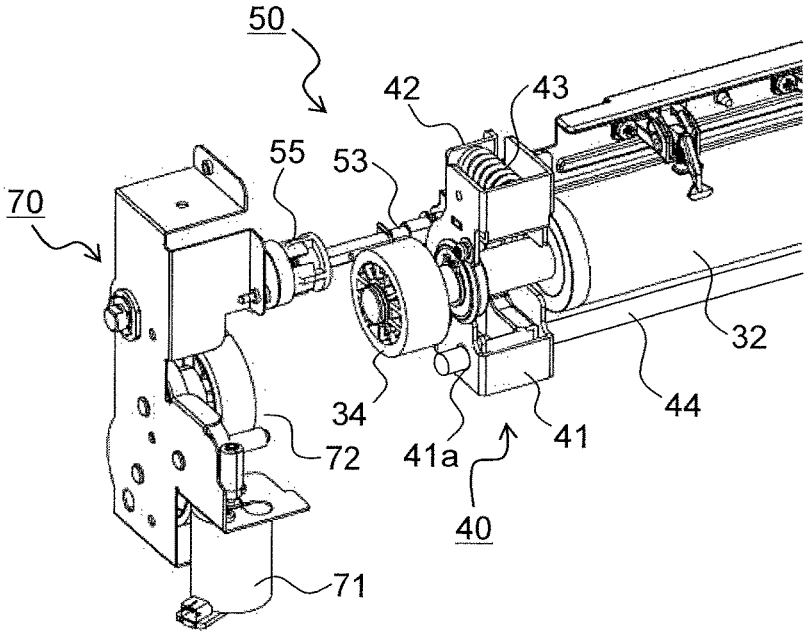
FIG. 4 is a perspective view showing a structure of and around the pressing mechanism and the pressure changing mechanism in the fixing device according to the one embodiment of the present disclosure, showing a state where the pressing roller presses the fixing member.
Figure 5:
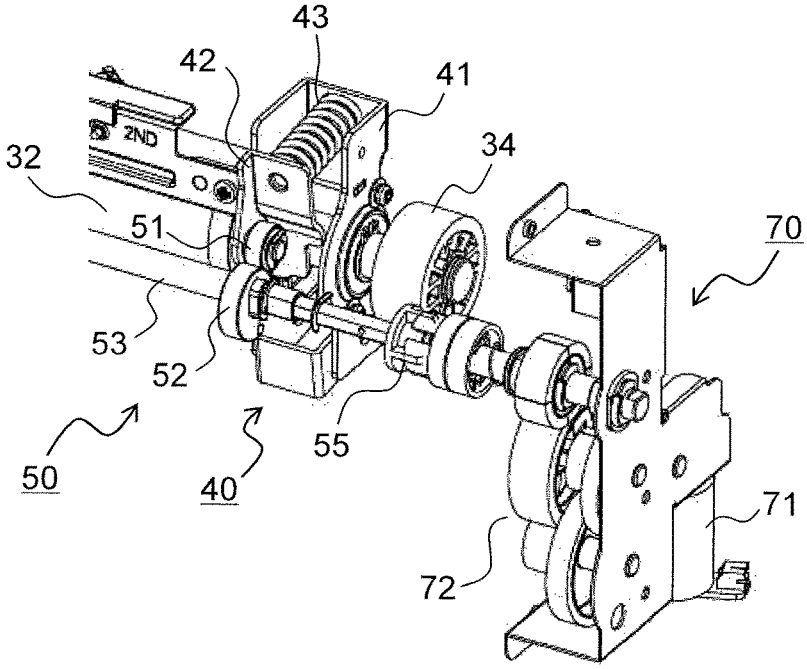
FIG. 5 is a perspective view showing a structure of and around the pressing mechanism and the pressure changing mechanism in the fixing device according to the one embodiment of the present disclosure, showing a state where the pressure of the pressing roller against the fixing member is removed.

FIGS. 3 to 5 are perspective views showing the pressing mechanism 40 and the pressure changing mechanism 50 in the fixing device 30. FIGS. 3 and 4 show a state where the pressing roller 32 is pressing the fixing member 31, and FIG. 5 shows a state where the pressure of the pressing roller 32 against the fixing member 31 is removed. The fixing member 31 is omitted from illustration for convenience of explanation.

The pressing mechanism 40 serves to put the pressing roller 32 in pressed contact with the fixing member 31, thereby to generate the nip pressure at the fixing nip portion N. The pressing mechanism 40 includes a holding member 41, a spring compressing member 42, and a pressurizing spring (a first biasing member) 43. A pair of pressing mechanisms 40 is provided one at each end of the pressing roller 32. FIGS. 3 to 5 show only the pressing mechanism 40 arranged at one end of the pressing roller 32.

The holding member 41 is formed in a predetermined shape out of a metal plate. Approximately in a middle part of the holding member 41, the pressing roller 32 is rotatably pivoted. In a lower part of the holding member 41, an insertion hole 41*a* is formed into which a swing shaft 44 (see FIG. 4) is inserted. The swing shaft 44 is rotatably supported on a housing of the fixing device 30. The holding member 41 is held on the housing of the fixing device 30 so as to be swingable, with the swing shaft 44 as a pivot, in such directions as to make the pressing roller 32 approach and recede from the fixing member 31. One end of the pressurizing spring 43 is in contact with an upper part of the holding member 41.

The spring compressing member 42 is formed in a predetermined shape out of a metal plate. The spring compressing member 42 is swingably held on the housing of the fixing device 30 at the same pivot (the swing shaft 44) as the holding member 41. The other end of the pressurizing spring 43 is in contact with an upper part of the spring compressing member 42. To the spring compressing member 42, a cylindrical roller 51 (see FIG. 5) is rotatably attached.

With the pressurizing spring 43 in a state where it is compressed from its natural length, its opposite ends are in contact with the holding member 41 and the spring compressing member 42. Thus, the holding member 41 and the spring compressing member 42 are biased in the directions away from each other by the pressurizing spring 43. That is, the pressurizing spring 43 biases the holding member 41 in such a direction that the pressing roller 32 approaches the fixing member 31. Thus, the pressing roller 32 is put into pressed contact with the fixing member 31, and a predetermined nip pressure is applied at the fixing nip portion N.

The pressure changing mechanism 50 serves to vary the biasing force of the pressurizing spring 43. The pressure changing mechanism 50 includes a pair of eccentric cams 52 arranged one at each end of the pressing roller 32 and a rotary coupling shaft 53. FIGS. 3 and 5 show only the eccentric cam 52 arranged at one end of the pressing roller 32.

At one end of the rotary coupling shaft 53, a driving coupling 55 is provided which is coupled to a gear train 72 in a driving portion 70, which will be described later. To the rotary coupling shaft 53, a pair of eccentric cams 52 is fixed with the same phase. Thus, the rotary driving force transmitted from the driving portion 70 is transmitted to the right and left eccentric cams 52 at the same time, and the biasing force of the pressurizing spring 43 at either end of the pressing roller 32 is changed simultaneously.

The eccentric cam 52 is rotatable together with the rotary coupling shaft 53, and makes contact with the roller 51 attached to the spring compressing member 42. The eccentric cam 52 is so formed that the distance from the rotation center to the outer circumferential face varies in the circumferential direction. The outer circumferential face of the eccentric cam 52 has a pressing position (a large-diameter part) where the pressing roller 32 is pressed toward the fixing member 31 and a releasing position (a small-diameter part) where the radios from the rotation center is smaller than at the pressing position. When the eccentric cam 52 is rotated and the pressing position (a large-diameter part) is put into contact with the roller 51, the biasing force of the pressurizing spring 43 is generated and the holding member 41 swings in the clockwise direction in FIG. 2 (the first direction), so that a nip pressure is applied at the fixing nip portion N. On the other hand, as shown in FIG. 5, when the eccentric cam 52 is rotated in the reverse direction and the removed position (a small-diameter part) is put into contact with the roller 51, the biasing force of the pressurizing spring 43 is removed or reduced and the holding member 41 swings in the counter-clockwise direction (the second direction) in FIG. 2, so that the nip pressure is removed.

The driving portion 70 includes a motor 71 and the gear train 72, and is arranged at one end of the pressing roller 32. The motor 71 is, for example, a DC motor that is rotatable in the forward and reverse directions. As the motor 71 is driven to rotate by a motor drive circuit (unillustrated), the eccentric cam 52 is rotated in the forward or reverse direction via the gear train 72, the driving coupling 55, and the rotary coupling shaft 53.

The moving mechanism 60 (see FIG. 2) is configured such that, in coordination with the nip pressure being applied or removed by the pressure changing mechanism 50, and the moving mechanism 60 moves the fixing member 31 in the sheet width direction.

Specifically, as shown in FIG. 2, the moving mechanism 60 is provided at one end (the left end in FIG. 2) of the fixing member 31. The moving mechanism 60 includes a moving piece 61 (a moving member) which moves together with the fixing member 31 in the sheet width direction, an eccentric cam 62 (see FIG. 6) which has an outer circumferential face making contact with the moving piece 61 and in which the distance from the rotation center to the outer circumferential face varies in the circumferential direction, and a biasing member (a second biasing member) 63 which comprises a pressing spring biasing the moving piece 61 toward the eccentric cam 62. The eccentric cam 62 is an example of an "eccentric cam" according to the present disclosure.

Figure 6:
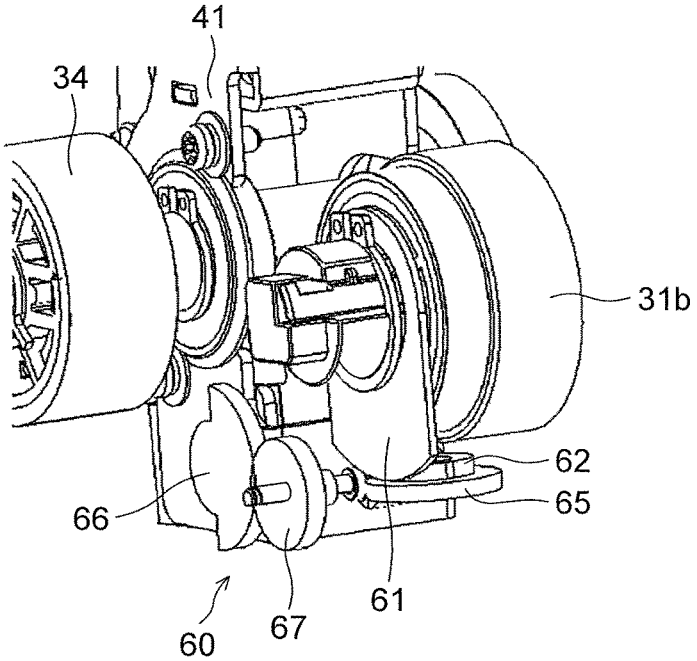
FIG. 6 is a perspective view showing a structure of and around a moving mechanism in the fixing device according to the one embodiment of the present disclosure.
Figure 7:
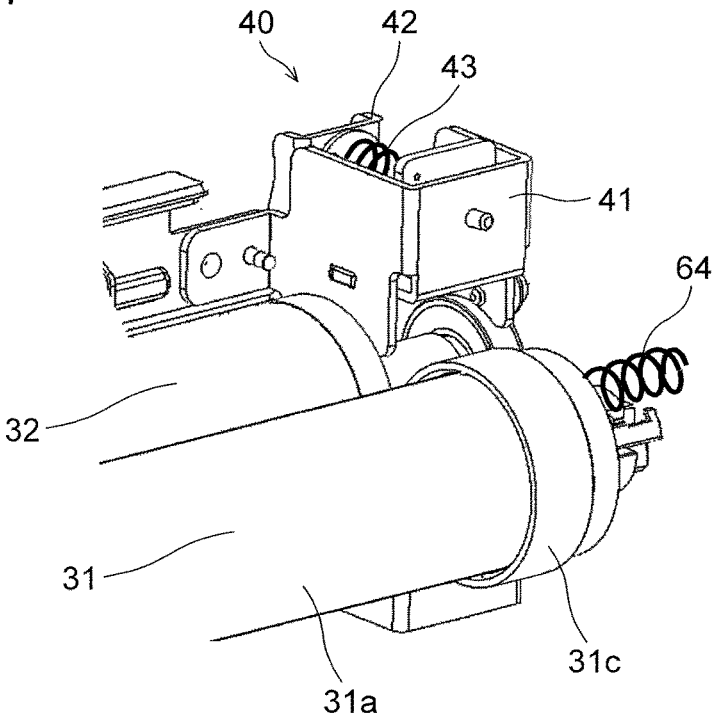
FIG. 7 is a perspective view showing a structure of and around the other end of the fixing member in the fixing device according to the one embodiment of the present disclosure.

As shown in FIGS. 2 and 6, the moving piece 61 is attached to a rotary shaft of the fixing member 31 and is in contact with the outer circumferential face of the cap 31*b*. As shown in FIGS. 2 and 7, at the other end of the fixing member 31 (the outer side face of the cap 31*c*), a biasing member (a third biasing member) 64 is provided which comprises a pressing spring biasing the fixing member 31 toward the moving piece 61. Thus, as the moving piece 61 moves in the sheet width direction, the fixing member 31 moves together with the moving piece 61 in the sheet width direction. Owing to the fixing member 31 being put into pressed contact with the moving piece 61 by the biasing member 64, the fixing belt 31*a* is prevented from meandering. The biasing member 63 is so set that its biasing force is stronger than the biasing force of the biasing member 64.

Figure 8:
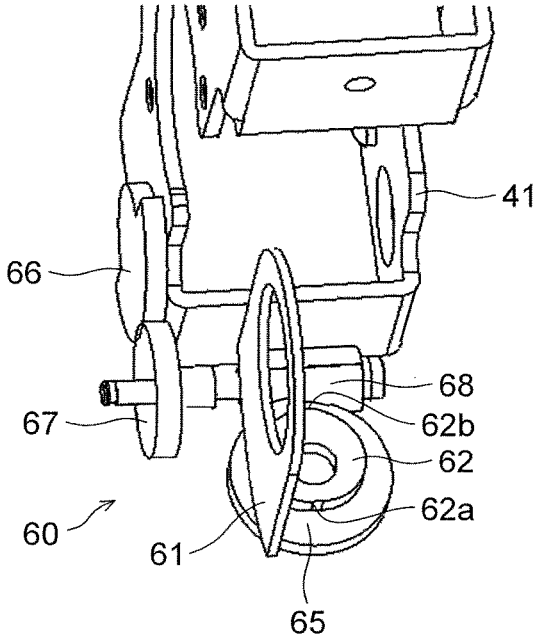
FIG. 8 is a perspective view showing a structure of the moving mechanism in the fixing device according to the one embodiment of the present disclosure.

As shown in FIG. 8, the outer circumferential face of the eccentric cam 62 has a small-diameter part 62*a* in which the distance from the rotation center to the outer circumferential face is shortest, and a large-diameter part 62*b* in which the distance from the rotation center to the outer circumferential face is longest. The outer circumferential face of the eccentric cam 62 is so formed that the distance from the rotation center to the outer circumferential face gradually varies between the small-diameter part 62*a* and the large-diameter part 62*b*. When the small-diameter part 62*a* of the eccentric cam 62 is in contact with the moving piece 61, the moving piece 61 and the fixing member 31 are arranged at the rightmost position, and when the large-diameter part 62*b* of the eccentric cam 62 is in contact with the moving piece 61, the moving piece 61 and the fixing member 31 are arranged at the leftmost position. Thus, as the eccentric cam 62 rotates, the moving piece 61 and the fixing member 31 integrally move in the sheet width direction.

The eccentric cam 62 is made of resin and is formed integrally with a gear 65.

The moving mechanism 60 is provided at one end (the left end) of the swing shaft 44 (see FIG. 4) of the holding member 41. The moving mechanism 60 includes a swing gear 66 which turns about the swing shaft 44 together with the holding member 41, a gear 67 which meshes with the swing gear 66, and a worm gear 68 which is provided on a rotary shaft of the gear 67 and rotates integrally with the gear 67 and which meshes with a gear 65. Thus, the eccentric cam 62 is rotatable in coordination with the swinging of the holding member 41. The gear 67, the worm gear 68, and the gear 65 are an example of a "middle gear" according to the present disclosure, and transmit the driving force to the eccentric cam 62 from the swing gear 66.

The gear 67 incorporates a one-way clutch so that the gear 67 rotates only when the swing gear 66 turns in the counter-clockwise direction (a predetermined direction) in FIG. 6. Thus, when the swing gear 66 turns in the counter-clockwise direction in FIG. 6, the gear 67 and the worm gear 68 turn in the clockwise direction in FIG. 6, so that the gear 65 and the eccentric cam 62 turn in the clockwise direction in FIG. 8. On the other hand, when the swing gear 66 turns in the clockwise direction in FIG. 6, the gear 67 does not turn, so that the worm gear 68, the gear 65, and the eccentric cam 62 do not turn. That is, the eccentric cam 62 only turns in one direction (the clockwise direction in FIG. 8).

Next, the operation of the pressing mechanism 40, the pressure changing mechanism 50, and the moving mechanism 60 in the fixing device 30 according to this embodiment will be described. In a normal printing state, the pressing position (a large-diameter part) of the eccentric cam 52 is in contact with the roller 51, and as shown in FIGS. 3 and 4, the pressurizing spring 43 is compressed by a predetermined amount by the holding member 41 and the spring compressing member 42. As a result, a predetermined biasing force acts on the holding member 41 from the pressurizing spring 43, and the fixing member 31 is put into pressed contact with the pressing roller 32 under a predetermined nip pressure.

When the sheet 6 is jammed at the fixing nip portion N, the motor 71 is driven to rotate by a predetermined amount in the predetermined direction, and thereby the eccentric cam 52 is rotated by the predetermined amount, so that the releasing position (small-diameter part) of the eccentric cam 52 is put into contact with the roller 51. As a result, the spring compressing member 42 swings in the direction away from the holding member 41, and thus the biasing force acting on the holding member 41 from the pressurizing spring 43 becomes weaker than in the state shown in FIG. 4. In this way, the nip between the fixing member 31 and the pressing roller 32 is released, and jam handling is now possible.

Here, the holding member 41 and the swing gear 66 turn in the counter-clockwise direction in FIG. 6, the gear 67 and the worm gear 68 turn in the clockwise direction in FIG. 6, and the gear 65 and the eccentric cam 62 turn in the clockwise direction in FIG. 8. Thus, the moving piece 61 and the fixing member 31 move by the predetermined amount in the sheet width direction.

After the jam handling is finished, the eccentric cam 52 is rotated by the predetermined amount in the opposite direction, and thereby the pressing position (large-diameter part) of the eccentric cam 52 is put back into contact with the roller 51 as shown in FIG. 3. This establishes a printing state in which the fixing member 31 is in pressed contact with the pressing roller 32 under the predetermined nip pressure.

Here, the holding member 41 and the swing gear 66 turn in the clockwise direction in FIG. 6, but the gear 67 does not turn, and the worm gear 68, the gear 65, and the eccentric cam 62 also do not turn. Thus, the moving piece 61 and the fixing member 31 do not move in the sheet width direction.

When jam handling as described above is repeated, the contact position of the eccentric cam 62 with the moving piece 61 moves repeatedly between the small-diameter part 62*a* and the large-diameter part 62*b*, so that the moving piece 61 and the fixing member 31 reciprocate within a predetermined range in the sheet width direction.

In this embodiment, as described above, the moving mechanism 60 moves the fixing member 31 in the sheet width direction in coordination with the nip pressure being removed by the pressure changing mechanism 50. Thus, when the nip pressure is removed by the pressure changing mechanism 50, the fixing member 31 is moved in the sheet width direction; this permits the position on the fixing belt 31*a* at which a width-direction end part of the sheet 6 passes to be moved in the sheet width direction. That is, the positions of the width-direction end part of the sheet 6 and the fixing belt 31*a* relative to each other can be changed in the sheet width direction. This helps suppress wearing of the fixing belt 31*a* by the width-direction end part of the sheet 6. As a result, it is possible to suppress image defects when a large-size sheet 6 is passed.

The moving mechanism 60 operates in coordination with the nip pressure being removed by the pressure changing mechanism 50, so that it is not necessary to additionally provide a driving source for operating the moving mechanism 60.

As described above, owing to the moving mechanism 60 being provided with the moving piece 61 which moves together with the fixing member 31 in the sheet width direction and the eccentric cam 62 which is rotatable in coordination with the swinging of the holding member 41, as the holding member 41 swings, the eccentric cam 62 rotates, and the moving piece 61 and the fixing member 31 move in the sheet width direction. Thus, it is possible to easily move the fixing member 31 in the sheet width direction in coordination with the nip pressure being removed by the pressure changing mechanism 50.

As described above, at the other end of the fixing member 31, the biasing member 64 is provided which biases the fixing member 31 toward the moving piece 61. Thus, it is possible to suppress the fixing member 31 moving away from the moving piece 61, so that it is possible to determine the width-direction position of the fixing member 31 with the moving piece 61.

As described above, the moving mechanism 60 includes the swing gear 66 which turns about the swing shaft 44 together with the holding member 41, and the middle gears (the gear 67, the worm gear 68, and the gear 65) which transmit the driving force to the eccentric cam 62 from the swing gear 66. Thus, it is possible to easily rotate the eccentric cam 62 in coordination with the swinging of the holding member 41.

As described above, the gear 67 is provided with the one-way clutch which transmits the driving force to the eccentric cam 62 from the swing gear 66 only when the swing gear 66 turns in the predetermined direction (the counter-clockwise direction in FIG. 6). Thus, when the nip pressure is removed (when the holding member 41 is swung in the counter-clockwise direction in FIG. 6), the eccentric cam 62 turns by the predetermined amount in the clockwise direction in FIG. 8, but when the nip pressure is applied (when the holding member 41 is swung in the clockwise direction in FIG. 6), the eccentric cam 62 does not turn in the opposite direction (the counter-clockwise direction in FIG. 8). That is, it is possible to easily prevent the fixing member 31 from returning to its original position when the nip pressure is applied. Thus, the position on the fixing belt 31*a* at which a width-direction end part of the sheet 6 passes can be easily moved in the sheet width direction.

The embodiments disclosed herein should be understood to be in every respect illustrative and not restrictive. The scope of the present disclosure is not defined by the description of embodiments given above but by the appended claims, and encompasses any modifications made in the sense and scope equivalent to those of the claims.

For example, although the embodiments described above deal with an example where the present disclosure is applied to a monochrome printer, this is not meant to limit the present disclosure. Needless to say, the present disclosure find applications in a variety of image forming apparatuses provided with a fixing device in which a nip pressure at a fixing nip portion can be removed, such as color printers, monochrome copiers, digital multifunction peripherals, and facsimile machines.

Although the embodiments described above deal with an example of a configuration where the fixing member 31 is moved in the sheet width direction in coordination with the nip pressure at the nip portion N being removed, a configuration is also possible where the fixing member 31 moves in the sheet width direction in coordination with the nip pressure being applied. That is, the one-way clutch may be configured to permit the gear 67 to rotate only when the swing gear 66 turns in the clockwise direction in FIG. 6.

Figure 9:
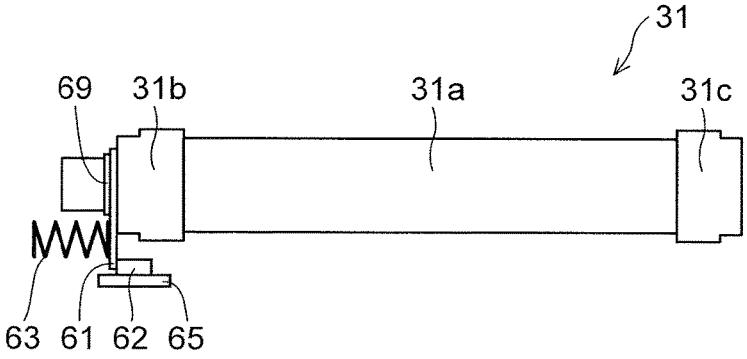
FIG. 9 is a diagram showing a structure of and around a fixing member in a fixing device according to a first modified example of the present disclosure.

Although the embodiments described above deal with an example where the biasing member 64 biasing the fixing member 31 toward the moving piece 61 is provided so that the moving piece 61 and the fixing member 31 are moved integrally in the sheet width direction, this is not meant to limit the present disclosure. For example, as in a fixing device 30 of a first modified example according to the present disclosure shown in FIG. 9, the rotary shaft of the fixing member 31 may be provided with a holding member 69 comprising a snap ring or the like which holds the moving piece 61 against the cap 31*b*. With this structure, it is possible to move integrally the moving piece 61 and the fixing member 31 in the sheet width direction without providing the biasing member 64.

Figure 10:
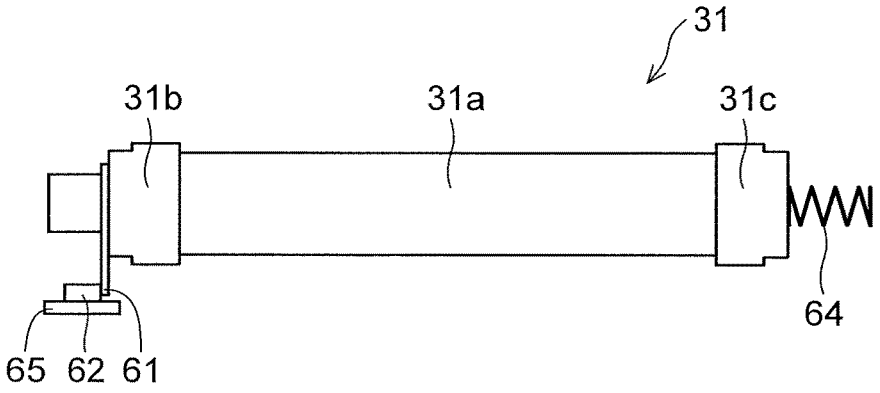
FIG. 10 is a diagram showing a structure of and around a fixing member in a fixing device according to a second modified example of the present disclosure.

Although the embodiments described above deal with an example where the biasing member 63 is provided so that the moving piece 61 is moved in the sheet width direction in coordination with the rotating of the eccentric cam 62, this is not meant to limit the present disclosure. For example, as in a fixing device 30 of a second modified example according to the present disclosure shown in FIG. 10, the eccentric cam 62 may be arranged outward (on the left side in FIG. 10) of the moving piece 61. With this structure, it is possible to move the moving piece 61 in the sheet width direction in coordination with the rotating of the eccentric cam 62 without providing the biasing member 63. In this case, the biasing member 64 serves also as the second biasing member biasing the moving piece 61 toward the eccentric cam 62.

Although the embodiments described above deal with an example where the fixing belt 31*a* is heated by an electromagnetic induction heating method, this is not meant to limit the present disclosure. The fixing belt 31*a* may be heated, for example, by use of a heater such as a halogen heater.

What is claimed is:

1. A fixing device comprising:

a fixing member having an endless fixing belt provided rotatably;

a pressing member forming a fixing nip portion by making contact with the fixing member;

a pressing mechanism pressing the pressing member against the fixing member to apply a nip pressure to the fixing nip portion;

a pressure changing mechanism changing the nip pressure at the fixing nip portion; and a moving mechanism moving the fixing member in a recording medium width direction which is perpendicular to a recording medium conveying direction, the fixing device fixing an unfixed toner image to the recording medium passing through the fixing nip portion, wherein the pressing mechanism includes:

a holding member which rotatably holds the pressing member and which is held so as to be swingable in such directions as to approach and recede from the fixing member; and a first biasing member biasing the holding member in such a direction that the pressing member approaches the fixing member, the pressure changing mechanism makes the first biasing member generate a biasing force to swing the holding member in a first direction, thereby to apply the nip pressure at the fixing nip portion, and removes or reduces the biasing force by the first biasing member to swing the holding member in a second direction opposite to the first direction, thereby to remove the nip pressure, the moving mechanism includes:

a moving member which is provided at one end of the fixing member and which moves in the recording medium width direction together with the fixing member;

an eccentric cam that has an outer circumferential face making contact with the moving member, that is so formed that a distance from a rotation center to the outer circumferential face varies in a circumferential direction, and that is rotatable in coordination with swinging of the holding member; and a second biasing member biasing the moving member toward to the eccentric cam, as the eccentric cam rotates, the moving member and the fixing member move in the recording medium width direction, and the moving mechanism moves the fixing member in the recording medium width direction in coordination with the nip pressure being applied or removed by the pressure changing mechanism.

2. The fixing device according to claim 1, wherein a third biasing member biasing the fixing member toward the moving member is provided at an other end of the fixing member.

3. The fixing device according to claim 1, wherein the moving mechanism further includes:

a swing gear provided on a swing shaft of the holding member and turning about the swing shaft together with the holding member, and one or more middle gears transmitting a driving force from the swing gear to the eccentric cam.

4. The fixing device according to claim 3, wherein the middle gears are provided with a one-way clutch transmitting the driving force from the swing gear to the eccentric cam only when the swing gear turns in a predetermined direction.

5. An image forming apparatus comprising;

the fixing device according to claim 1; and an image forming section.

* * * * *